US005690560A

United States Patent [19]

Ruiz

[11] Patent Number: 5,690,560

[45] Date of Patent: Nov. 25, 1997

[54] GRIP FOR GOLF CLUBS AND SPORTS RACKETS

[76] Inventor: Joseph F. Ruiz, 201 N. Concord Exchange, South St. Paul, Minn. 55075

[21] Appl. No.: 748,353

[22] Filed: Nov. 14, 1996

Related U.S. Application Data

[63] Continuation of Ser. No. 569,731, Dec. 8, 1995, abandoned.

[51] Int. Cl.[6] ..... A63B 49/08; A63B 53/14

[52] U.S. Cl. ..... 473/301; 473/551

[58] Field of Search ..... 473/302, 301, 473/300, 303, 204, 551, 568; 273/81 R

[56] References Cited

U.S. PATENT DOCUMENTS

| | | |
|---|---|---|
| 1,139,843 | 5/1915 | Brown . |
| 1,556,781 | 10/1925 | Gjorup . |
| 2,166,044 | 7/1939 | Fletcher . |
| 2,177,143 | 10/1939 | Lamkin . |
| 2,195,626 | 4/1940 | Lamkin . |
| 2,200,626 | 5/1940 | Lamkin . |
| 3,489,031 | 1/1970 | Meier . |
| 5,275,407 | 1/1994 | Soong . |
| 5,294,117 | 3/1994 | Huang . |

FOREIGN PATENT DOCUMENTS

| | | |
|---|---|---|
| 406007488A | 1/1994 | Japan . |
| 462155 | 3/1937 | United Kingdom . |
| 870021 | 6/1961 | United Kingdom . |

*Primary Examiner*—Mark S. Graham
*Attorney, Agent, or Firm*—Haugen and Nikolai, P.A.

[57] ABSTRACT

A moisture-absorbing grip for a handle of a golf club or a sports racket consists of an elongated strip of leather of a special transverse, cross-sectional profile which when spirally wound on the handle of a golf club or racket with the roughened nap side of the leather strip exposed provides a moisture-absorbing surface having ridges or peaks separated by arcuately curved grooves or valleys spirally oriented along the length of the club or racket handle. The resulting grip is not only moisture absorbent but conforms well to the hand of a player gripping the club or racket so as to resist slipping even when the player's hand or hands are profusely perspiring.

3 Claims, 4 Drawing Sheets

GRIP FOR GOLF CLUBS AND SPORTS RACKETS

This is a Continuation of application Ser. No. 08/569,731, filed on Dec. 8, 1995, abandoned.

BACKGROUND OF THE INVENTION

I. Field of the Invention

This invention relates generally to sporting equipment, such as golf clubs, bats and rackets, and more particularly to an improved moisture absorbing grip adapted to conform to the contours of a player's fingers so as to prevent slippage between the club, bat or racket and the player's hand(s).

II. Discussion of the Prior Art

It is conventional practice in the manufacture of golf clubs, tennis and squash rackets and the like to provide a grip on the handle thereof for comfort and to resist any tendency for the club or racket to slip or twist in the player's hand. In most sports, it is quite common for the hand or hands of a player to perspire, thus often making it necessary for the player to wear a special glove or gloves for the purpose of absorbing moisture due to perspiration. This is primarily due to the fact that the grip material on the club or racket itself does not absorb such moisture. Instead, the surface of the grip becomes wet and slippery unless a moisture-absorbing glove is worn. Players may often resort to the application of some foreign material, such as rosin, tar or other tacky material to increase the coefficient of friction between the handle grip of the club or racket and the hand or glove of the player.

In the Brown U.S. Pat. No. 1,139,843, the perspiration problem is addressed by providing a grip comprising an inner wrapped layer of absorbent material, such as felt, over which is wound a strip of non-absorbent material that has a plurality of regularly-spaced perforations allowing moisture to pass therethrough to the underlying absorbent material.

In the Lamkin U.S. Pat. No. 2,200,626, the grip for a golf club shaft handle comprises a leather strip whose grain side is exposed. To improve the gripability, the '626 patent teaches the application of a tacky material comprising a mixture of carnauba wax, pitch and neatsfoot oil. To create ridges on the handle, a bead is created on the leather strip by providing a longitudinally extending cord about which the leather material is wrapped.

In a similar fashion, the golf club grip described in the Fletcher U.S. Pat. No. 2,166,044 provides an undulating surface on a grip by incorporating transversely extending fiber ribs on an outer covering made of leather, rubber or canvass. A difficulty arises in properly orienting such fiber strips, such as shown in the Lamkin and Fletcher patents, thus unnecessarily increasing the cost of manufacture of the grip. Moreover, neither of these prior art arrangements describe fabricating the grip entirely out of a moisture-absorbing leather material whereby there is no moisture buildup on the surface of the grip.

It is accordingly a principal object of the present invention to provide an improved grip for a club or racket which has moisture absorbing properties as well as a surface configuration that conforms to the contours of a player's hand(s) to provide improved club/racket control, obviating the need for a special glove.

SUMMARY OF THE INVENTION

The foregoing features and advantages of the invention are achieved by providing an elongated strip of leather of a predetermined width, the strip having a smooth grain side and a rough napped side. First and second lateral edges of the elongated strip are disposed on either side of a raised central portion, the central portion being on the napped side of the strip. The raised central portion of increased thickness has a rounded crest and tapers with an arcuate profile to the opposed lateral edges. The strip is spirally wound about the cylindrical handle of a club or racket with the grain side of the leather strip adhered to the handle and with the first edge of one spiral convolution abutting the second edge of an adjacent spiral convolution. The width of the strip is such that an arcuate spiral recess is created between the central portions of the one spiral convolution and its adjacent convolution that naturally conforms to the rounded contours of the player's fingers. In that the roughened nap side of the leather comprises the exposed surface of the grip, the leather material is much more able to absorb and later evaporate away perspiration from the hands. The roughened surface and the spiral arcuate groove further serves to limit any tendency for the club or racket to slip in the player's hand.

DESCRIPTION OF THE DRAWINGS

The foregoing features, objects and advantages of the invention will become apparent to those skilled in the art from the following detailed description of the preferred embodiment, especially considered in conjunction with the accompanying drawings in which like numerals in the several views refer to corresponding parts.

DESCRIPTION OF THE PREFERRED EMBODIMENT

Figure 1:
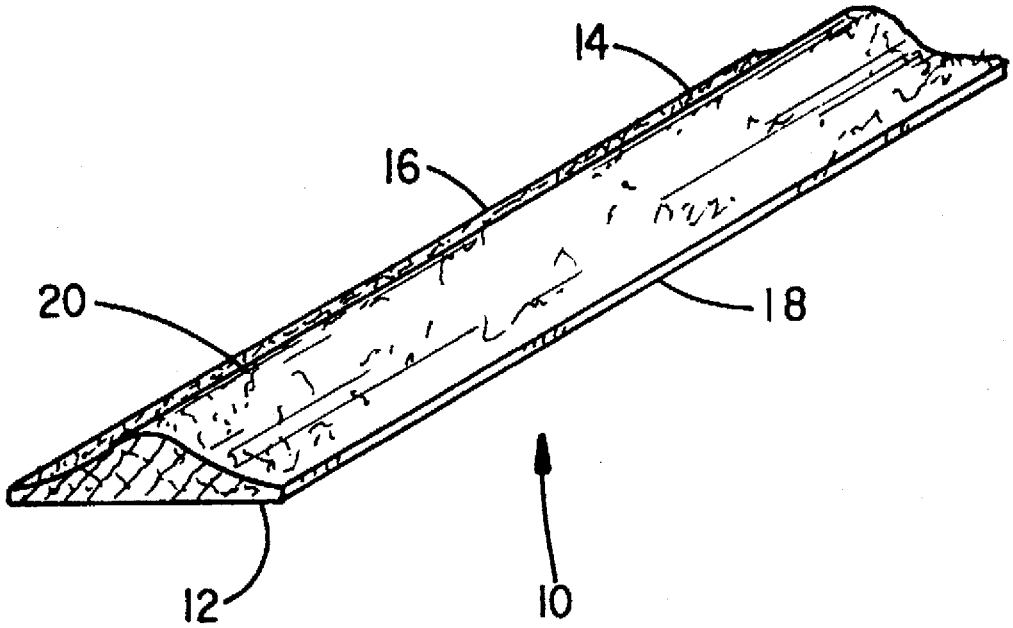
FIG. 1 is a partial perspective view of a leather strip used in forming the grip of the present invention.

Referring to FIG. 1, there is indicated generally by numeral 10 a segment of an elongated strip of leather having a grain or hair side 12 and a roughened nap or flesh side 14. The leather strip 10 may be cow hide, horse hide, pig skin or other suitable leather material and typically may be in the range of from about ⅜ inches to ¾ inches in width.

The strip 10 has first and second lateral edges 16 and 18 and a raised central portion 20. As can best be seen from the exposed forward end of the strip shown in FIG. 1, the raised central portion 20 of greater thickness has a rounded crest and arcuately tapers along a curved profile from the crest to the lateral edges 16 and 18. The maximum height of the central portion may be about ⅛ inch above the grain underside 12 of the strip for a ⅜ inch width and about 3/16 inch for a strip ¾ inch in width.

Figure 2:
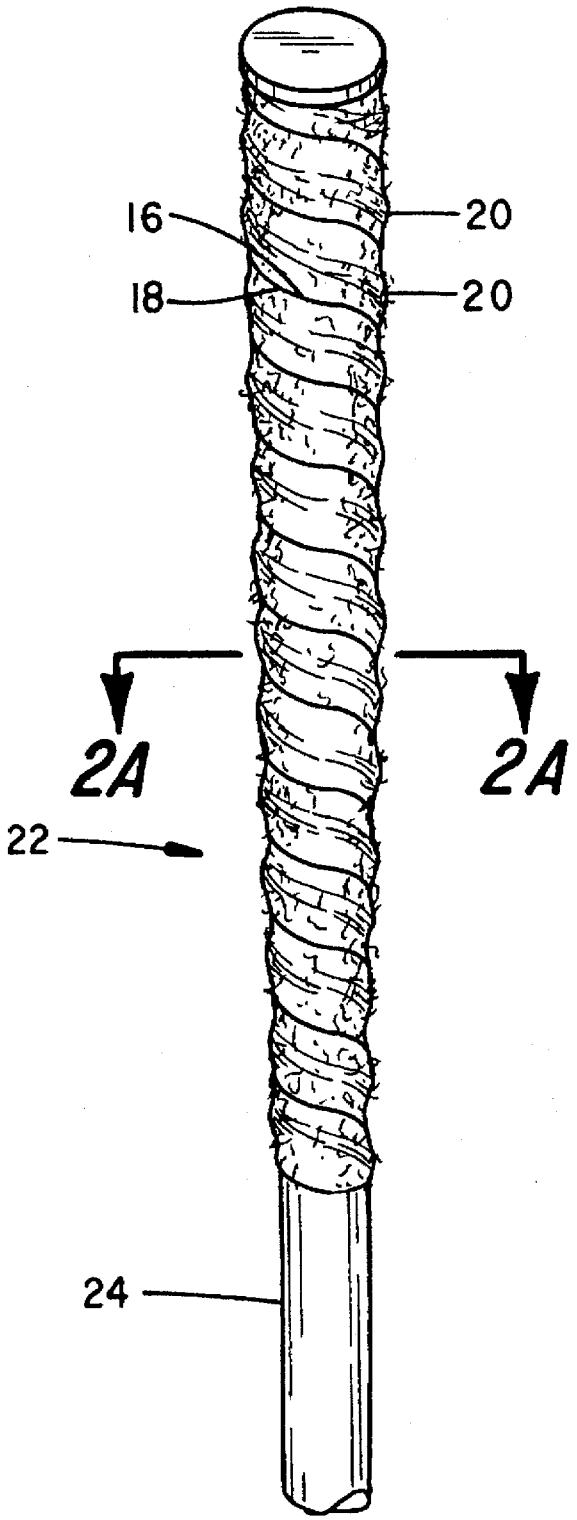
FIG. 2 is a partial side elevation of a golf club shaft having the grip material of the present invention spirally wound thereon to create the grip.
Figure 2A:
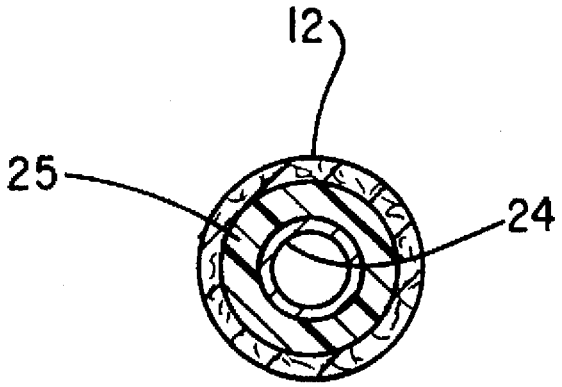
FIG. 2A is a cross-section view taken along line A—A in FIG. 2.

Referring now to FIG. 2, there is indicated generally by numeral 22 the handle portion on the upper end of the club shaft 24. The club shaft in the handle portion is of slightly enlarged diameter and is shown as having the strip material of FIG. 1 spirally wrapped thereon with the grain side 12 adhesively bonded to the club handle and with the nap or flesh side 14 of the leather exposed. The wrapping is made such that one lateral edge 16 on a first convolution directly abuts the lateral edge 18 of its adjacent convolution and with the raised central portion or crest 20 axially spaced and creating parallel spiral crests separated by an arcuate groove or valley. If it is found that the leather wrap 12 directly onto the club shaft 24 does not provide a large enough diameter to fit comfortable into the player's hands, it may be desirable to include a tubular plastic spacer layer 25, as shown in FIG. 2A, between the club's shaft and the leather wrap. It is has been found that by using a strip of about ⅝ inch in width, the spacing between crests comfortably receives the rounded contours of most adult player's fingers therein. A slightly narrower width strip can be used in the case of a club or racket to be used by children.

In that the roughened nap surface 14 of the strip 10 is exposed upon its being spirally wrapped on the handle of the club shaft, it provides an absorbent surface precluding the buildup of a slippery moisture layer thereon. The spiral crests and valleys formed along the axial length of the club handle portion resists any tendency for the club to shift longitudinally in the player's hands and also inhibits unwarranted rotation upon impacting a ball with the club head.

Figure 3:
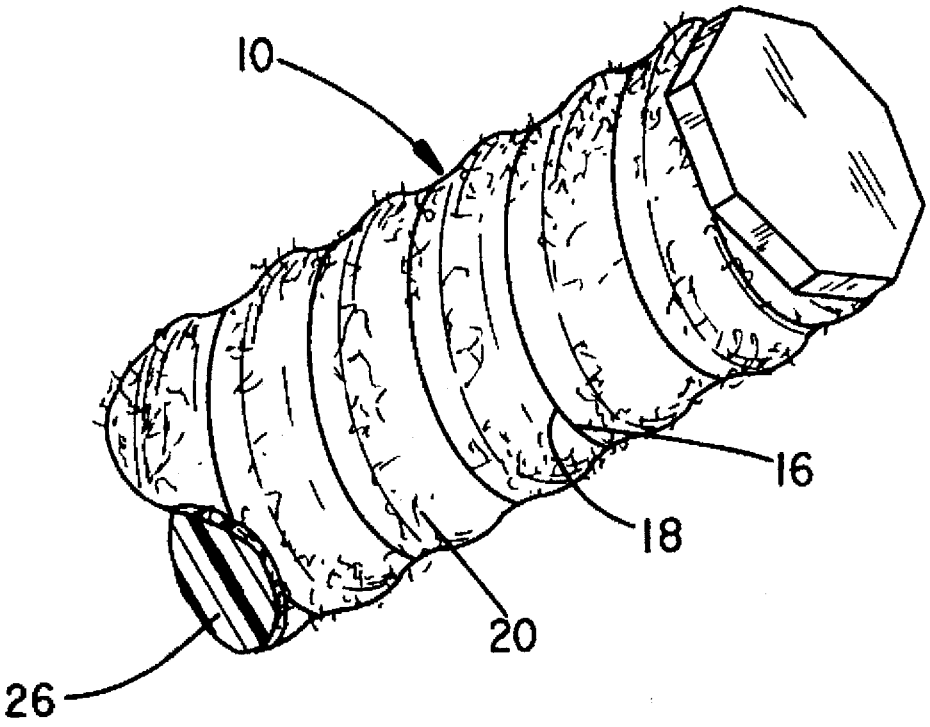
FIG. 3 shows the grip material of the present invention applied to the handle of a sports racket.

FIG. 3 shows a portion of a handle 26 which projects from a frame (not shown) supporting a net or webbing. Again, the strip material 10 is adhesively secured to the handle 26 and is wrapped in spiral fashion with a predetermined pitch such that the valleys defined between adjacent raised central portions 20 comfortably receive the fingers of the player therein. The strip material 10 is wrapped in the same manner as has been described in connection with the golf club handle of FIG. 2 so that the moisture absorbent napped surface is exposed and the grain surface is bonded to the handle. Thus, it provides an improved gripping surface, less prone to slipping during vigorous play.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

What is claimed is:

1. A moisture absorbing grip for a handle of a golf club or sports racket consisting of an elongated strip of leather of a predetermined width dimension, the strip having a smooth grain side and a rough napped side, the strip including first and second lateral edges on either side of a central portion, the central portion of said strip on the napped side being of a thickness greater than at the first and second lateral edges and arcuately tapering down to the first and second edges, the strip adapted to be spirally wound about the handle with the grain side contacting and adhered over its entire width dimension to the handle, the napped side exposed for absorbing moisture, and the first edge of one spiral convolution abutting the second edge of an adjacent spiral convolution, the predetermined width of the strip forming an arcuate spiral recess between the central portions of the one spiral convolution and the adjacent convolution for receiving and conforming to the rounded contour of the fingers of a player therein.

2. The moisture-absorbing grip as in claim 1 wherein the predetermined width dimension is in the range from about ⅜ inch to ¾ inch and the central portion has a minimum thickness of ⅛ inch and maximum thickness of about 3/16 inch.

3. The moisture-absorbing grip as in claim 1 wherein the central portion includes a rounded crest.

* * * * *